US006821056B1

(12) United States Patent
Mansour

(10) Patent No.: US 6,821,056 B1
(45) Date of Patent: Nov. 23, 2004

(54) GROUT INJECTING/STRUCTURE ANCHORING SYSTEM

(76) Inventor: Patricia J. Mansour, 5310 N. Branch Ave., Tampa, FL (US) 33614

( * ) Notice: Subject to any disclaimer, the term of this patent is extended or adjusted under 35 U.S.C. 154(b) by 0 days.

(21) Appl. No.: 10/394,815

(22) Filed: Mar. 21, 2003

(51) Int. Cl.[7] ..... E02D 5/00; E02D 17/02

(52) U.S. Cl. ..... 405/230; 405/238; 405/244; 52/125.1

(58) Field of Search ..... 405/230, 231, 405/233, 238, 244, 249; 52/125.1, 126.1, 126.5, 126.6, 292

(56) References Cited

U.S. PATENT DOCUMENTS 3,243,962 A * 4/1966 Ratliff ..... 405/266
3,796,055 A * 3/1974 Mahony ..... 405/230
4,591,466 A * 5/1986 Murray et al. ..... 405/230
4,678,373 A * 7/1987 Langenbach, Jr. ..... 405/230
4,997,314 A * 3/1991 Hartman ..... 405/236
5,013,190 A * 5/1991 Green ..... 405/230
5,018,905 A * 5/1991 Kinder ..... 405/230
5,123,209 A * 6/1992 Nally ..... 405/230
5,176,472 A * 1/1993 Kinder ..... 405/230
5,482,407 A * 1/1996 Raaf ..... 405/230
5,492,437 A * 2/1996 Ortiz ..... 405/230
5,904,447 A * 5/1999 Sutton et al. ..... 405/263
5,919,005 A * 7/1999 Rupiper ..... 405/244
5,934,836 A * 8/1999 Rupiper et al. ..... 405/244
6,142,710 A * 11/2000 Holland et al. ..... 405/230
6,503,024 B2 * 1/2003 Rupiper ..... 405/230

* cited by examiner

*Primary Examiner*—Jong-Suk (James) Lee
(74) *Attorney, Agent, or Firm*—Edward P. Dutkiewicz

(57) ABSTRACT

A structure has a foundation positionable on soil over bedrock. A hollow cylindrical supportive tube has a closed bottom end, an open top end and a plurality of spaced apertures along the length. A bracket coupled to the tube is adapted to be securely placed under a foundation of a structure. A pressurized grout dispensing unit is coupled to the upper end of the filling tube.

1 Claim, 4 Drawing Sheets

GROUT INJECTING/STRUCTURE ANCHORING SYSTEM

BACKGROUND OF THE INVENTION

1. Field of the Invention

The present invention relates to a grout injecting/structure anchoring system and more particularly pertains to solidifying a structure by supporting it from bedrock and filling any subterranean voids which would otherwise cause structural instability.

2. Description of the Prior Art

The use of structural supports and stabilizers is known in the prior art. More specifically, structural supports and stabilizers previously devised and utilized for the purpose of supporting and stabilizing structures through known methods and apparatuses are known to consist basically of familiar, expected, and obvious structural configurations, notwithstanding the myriad of designs encompassed by the crowded prior art which has been developed for the fulfillment of countess objectives and requirements.

| Patent No. | Issue Date | Inventor | Title |
|---|---|---|---|
| 4,507,069 | Mar. 26, 1985 | Murray et al. | APPARATUS FOR POSITIONING AND STABILIZING A CONCRETE SLAB |
| 4,695,203 | Sep. 22, 1987 | Gregory | METHOD AND APPARATUS FOR SHORING AND SUPPORTING A BUILDING FOUNDATION |
| 4,673,315 | Jun. 16, 1987 | Shaw et al. | APPARATUS FOR RAISING AND SUPPORTING A BUILDING |
| 5,018,905 | May 28, 1991 | Kinder | FOUNDATION SHORING METHOD AND MEANS |
| 6,468,002 | Oct. 22, 2002 | Gregory et al. | FOUNDATION SUPPORTING AND LIFTING SYSTEM AND METHOD |
| 6,514,012 | Feb. 4, 2003 | Gregory et al. | SYSTEM AND METHOD FOR RAISING AND SUPPORTING A BUILDING AND CONNECTING ELONGATED FILING SECTIONS |
| 4,591,466 | May 27, 1986 | Murray et al. | METHOD FOR POSITIONING AND STABILIZING A CONCRETE SLAB |

While these devices fulfill their respective, particular objectives and requirements, the aforementioned patents do not describe a grout injecting/structure anchoring system that allows solidifying a structure by supporting it from bedrock and filling any subterranean voids which would otherwise cause structural instability.

In this respect, the grout injecting/structure anchoring system according to the present invention substantially departs from the conventional concepts and designs of the prior art, and in doing so provides an apparatus primarily developed for the purpose of solidifying a structure by supporting it from bedrock and filling any subterranean voids which would otherwise cause structural instability.

Therefore, it can be appreciated that there exists a continuing need for a new and improved grout injecting/structure anchoring system which can be used for solidifying a structure by supporting it from bedrock and filling any subterranean voids which would otherwise cause structural instability. In this regard, the present invention substantially fulfills this need.

SUMMARY OF THE INVENTION

In view of the foregoing disadvantages inherent in the known types of structural supports and stabilizers now present in the prior art, the present invention provides an improved grout injecting/structure anchoring system. As such, the general purpose of the present invention, which will be described subsequently in greater detail, is to provide a new and improved grout injecting/structure anchoring system and method which has all the advantages of the prior art and none of the disadvantages.

To attain this, the present invention essentially comprises a structure, such as a house on a foundation. The structure is susceptible to instability. The instability is due to any subterranean voids. The structure has a foundation. The foundation is positionable on soil over bedrock.

A hollow cylindrical supportive tube is provided next. The supportive tube has a first inner diameter. The supportive tube is adapted to be inserted into soil adjacent to the foundation of the structure and through any subterranean void. The supportive tube has a closed bottom end. The closed bottom end is provided with a zap. The closed bottom end is firmly abutted to bedrock. The supportive tube has an open top end. The open top end is positioned adjacent to the foundation of the structure. The supportive tube further has a linear body between the top end and the bottom end. A plurality of equally spaced circular apertures is provided along the length of the linear body and around its circumference.

Further provided is an L-shaped support bracket. The support bracket is adapted to be securely placed under a foundation of a structure. The support bracket has a weight bearing horizontal portion. The weight bearing horizontal portion is adapted to support the foundation. The support bracket also has an aligning vertical portion. The aligning vertical portion has a pair of apertures. The apertures have horizontal bolts. The bolts are adapted to couple the support bracket to the foundation. The support bracket has adjusting elements. The adjusting elements include vertically oriented internally threaded sleeves. The adjusting elements further include a vertically oriented unthreaded sleeve. A cross brace and vertical bolts are provided. Each bolt has an upper nut. The support bracket is adapted to hold the foundation at a level desired by a user.

Provided last is a grout dispensing unit. The grout dispensing unit is coupled to the upper end of the filling tube and is for dispensing grout through the apertures of the tube beginning adjacent to the lower end. This allows grout to pass through the apertures of the tube and fill subterranean voids. This filling of the tube and the subterranean void thereby function to solidify the supportive tube. This further produces a massive anchoring flange of the filled subterranean void and is coupled to the supportive tube to add further support to the building structure.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved grout injecting/structure anchoring system which has all of the advantages of the prior art structural supports and stabilizers and none of the disadvantages.

It is another object of the present invention to provide a new and improved grout injecting/structure anchoring system which may be easily and efficiently manufactured and marketed.

It is further an object of the present invention to provide a new and improved grout injecting/structure anchoring system which is of durable and reliable constructions.

An even further object of the present invention is to provide a new and improved grout injecting/structure anchoring system which is susceptible of a low cost of manufacture with regard to both materials and labor, and which accordingly is then susceptible of low prices of sale to the consuming public, thereby making such grout injecting/structure anchoring system economically available to the buying public.

Even still another object of the present invention is to provide a grout injecting/structure anchoring system for solidifying a structure by supporting it from bedrock and filling any subterranean voids which would otherwise cause structural instability.

Lastly, it is an object of the present invention to provide a new and improved grout injecting/structure anchoring system. A structure has a foundation. The foundation is positionable on soil over bedrock. A hollow cylindrical supportive tube has a closed bottom end and an open top end. The supportive tube has a plurality of spaced apertures along the length. A bracket is coupled to the tube and is adapted to be securely placed under a foundation of a structure. A hollow cylindrical filling tube has a second diameter that is less than the first diameter. The filling tube is slidably received within the supportive tube. The filling tube has an open lower end and an open upper end. Lastly, a pressurized grout dispensing unit is coupled to the upper end of tie filling tube These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated and described the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
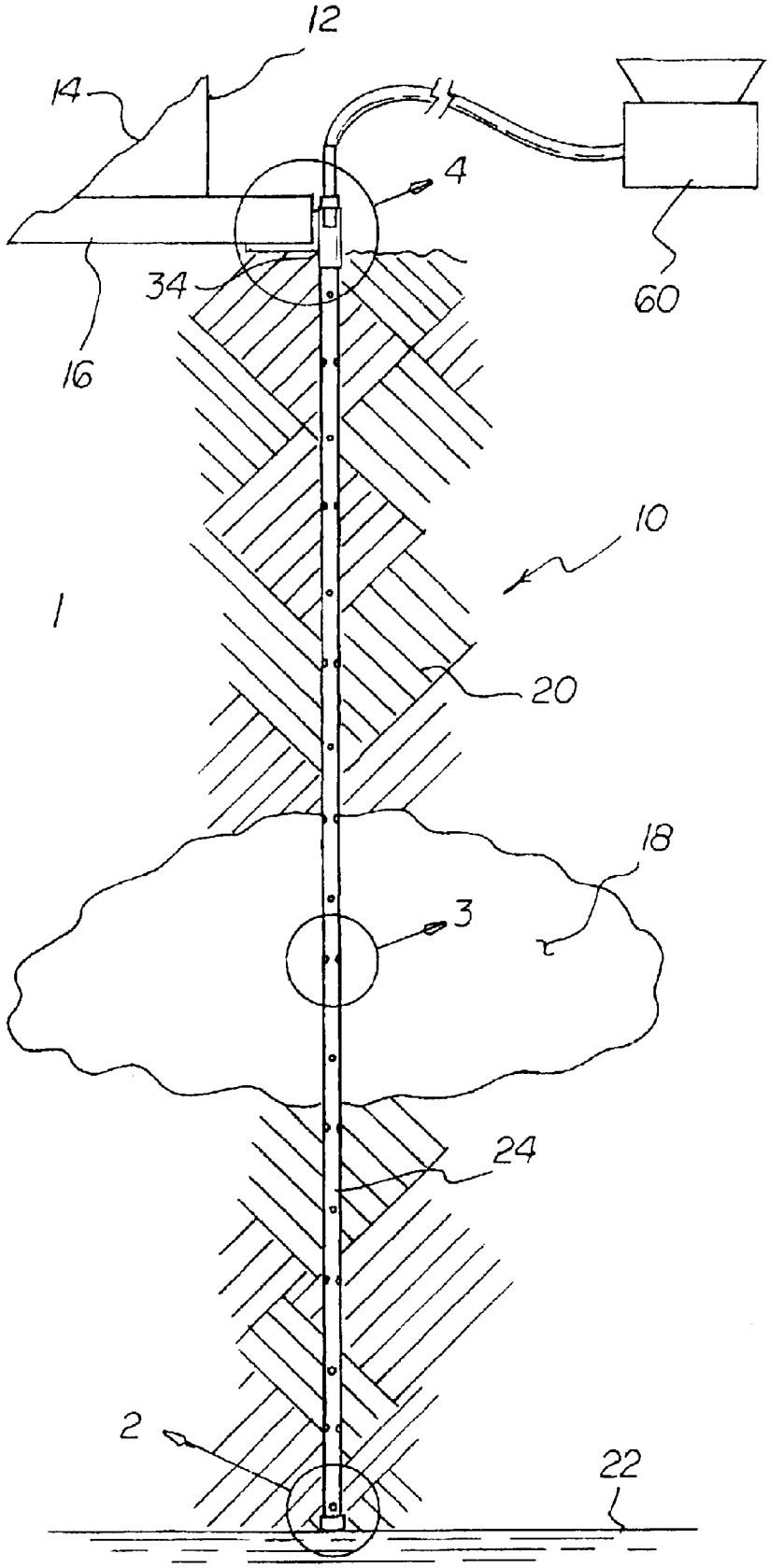
FIG. 1 is a side elevational view, partly in cross section, showing the grout injecting/structure anchoring system constructed in accordance with the principles of the present invention.
Figure 2:
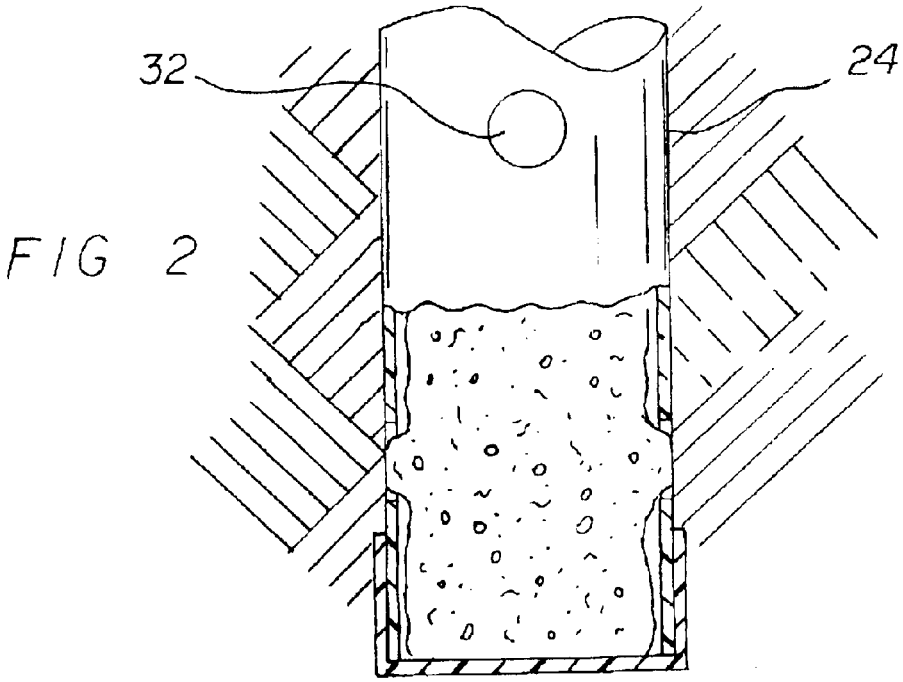
FIG. 2 is an enlarged cross sectional view of the system taken at circle 2 of FIG. 1, the view being a the initiating of the injection process.
Figure 3:
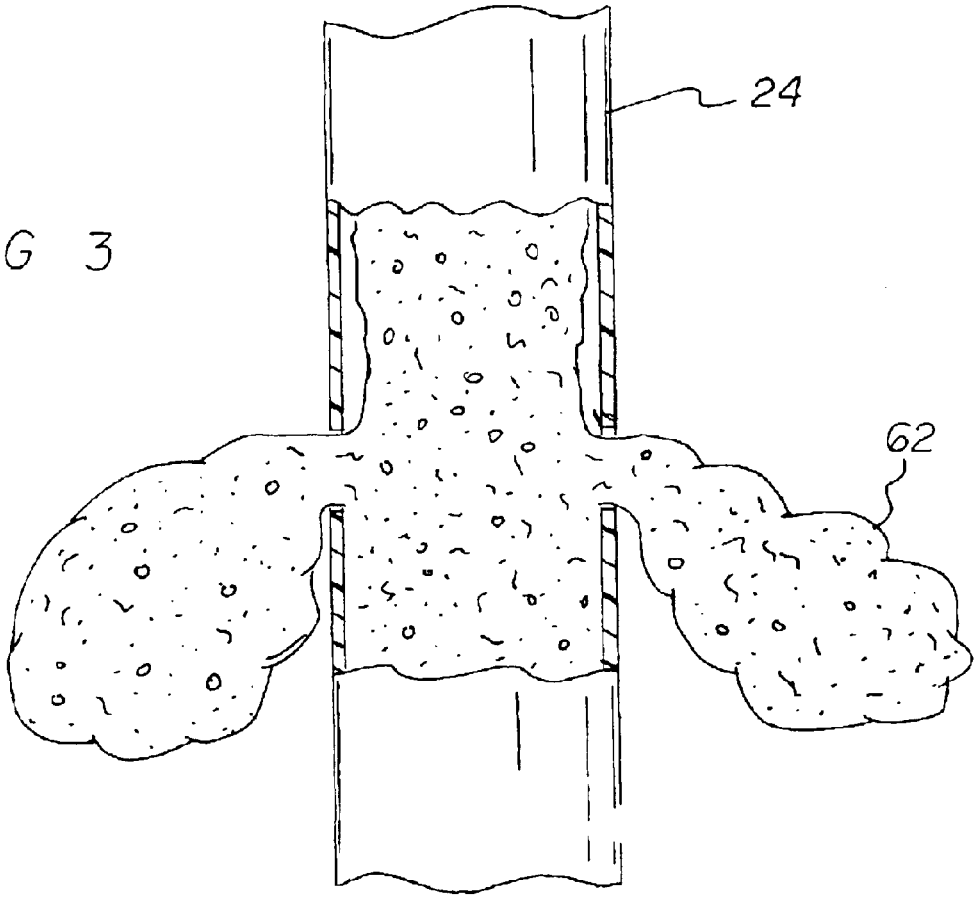
FIG. 3 is an enlarged cross sectional view of the system taken at circle 3 of FIG. 1, the view being an intermediate point of the injection process.
Figure 4:
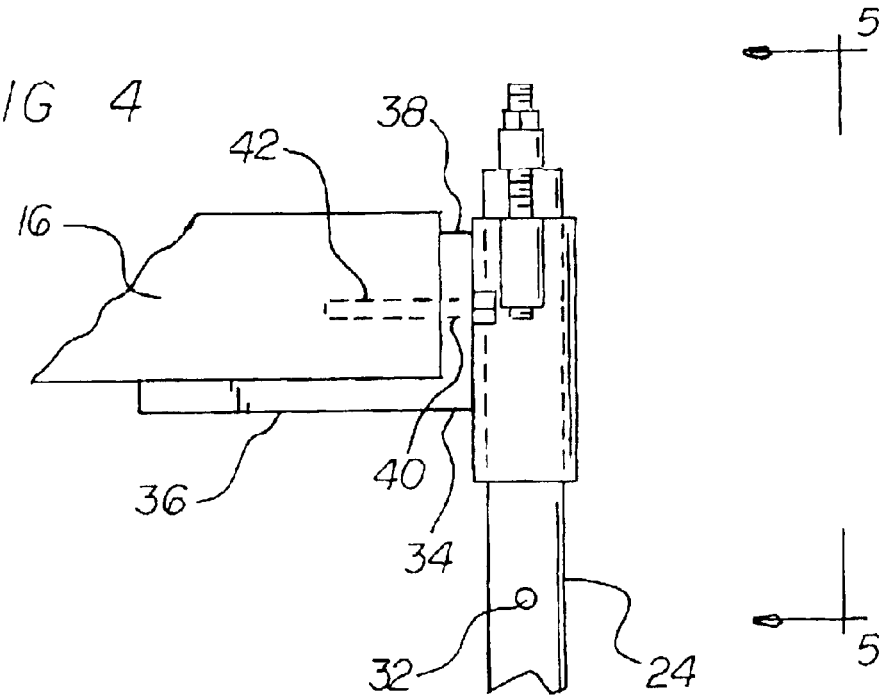
FIG. 4 is an enlarged cross sectional view of the system taken at circle 4 of FIG. 1.
Figure 5:
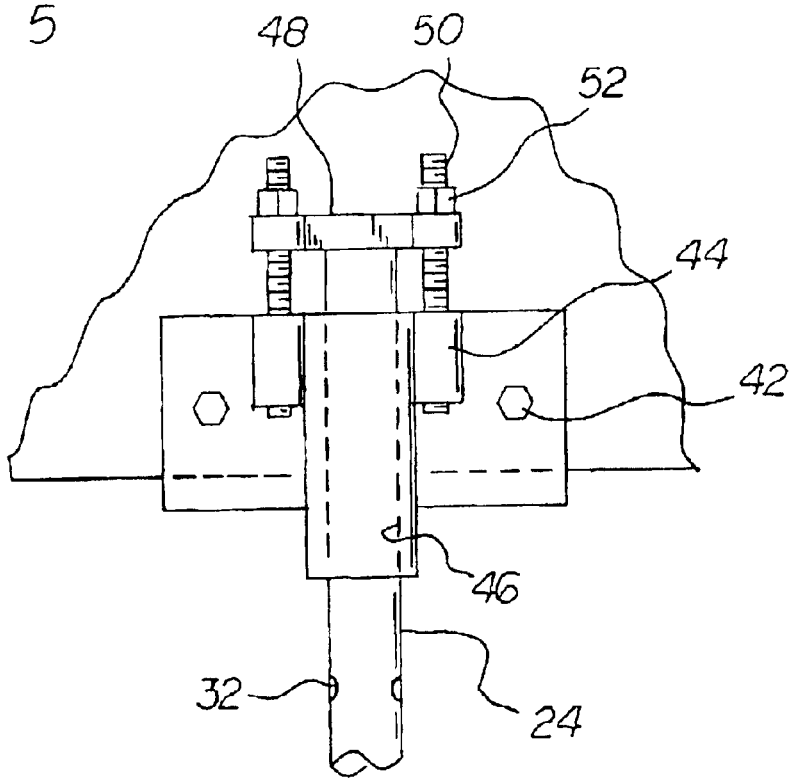
FIG. 5 is a side elevational view taken at line 5-5 of FIG. 4.
Figure 6:
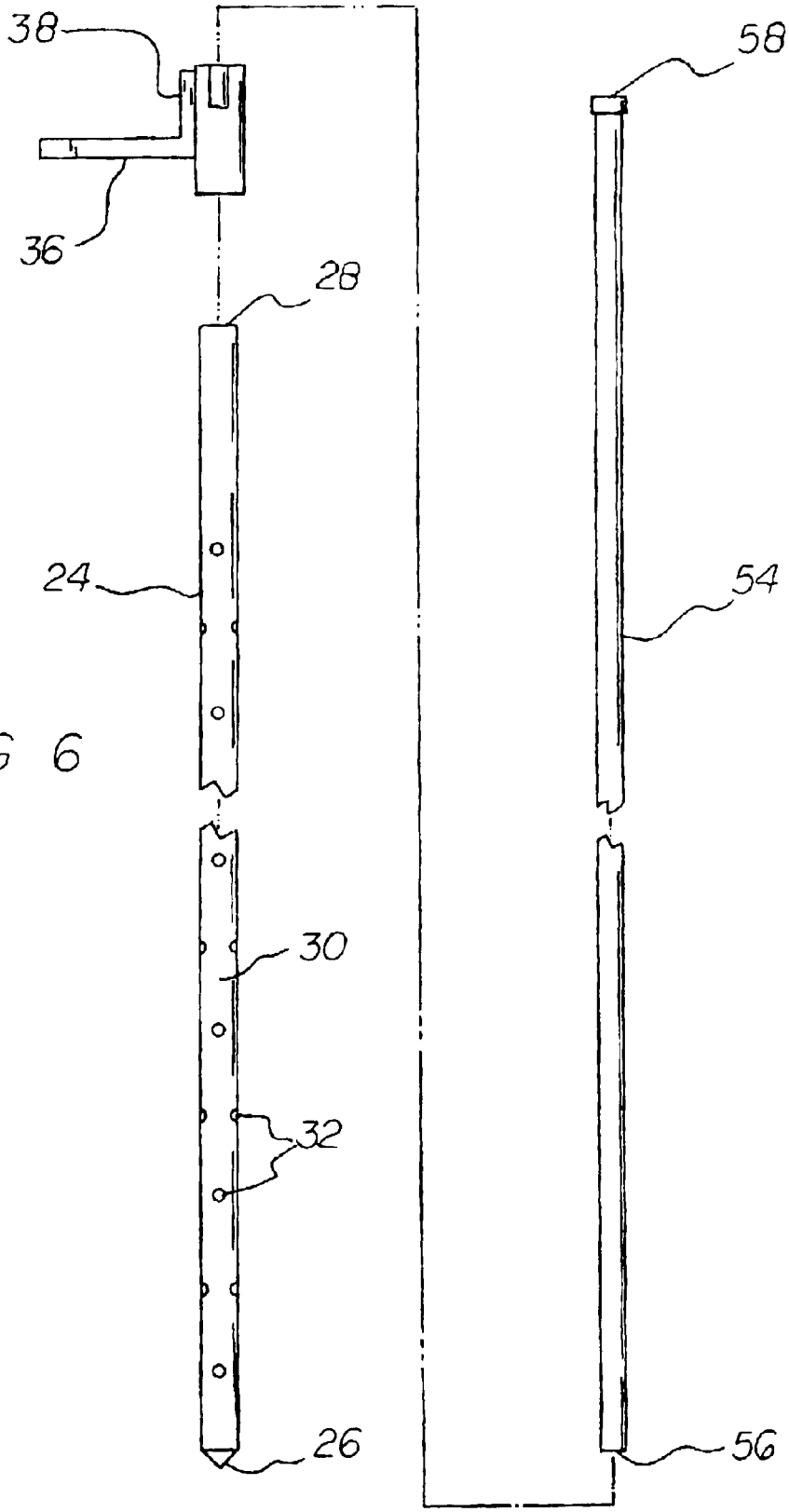
FIG. 6 is an exploded view of the system.

With reference now to the drawings, and in particular to FIG. 1 thereof, the preferred embodiment of the new and improved grout injecting/structure anchoring system embodying the principles and concepts of the present invention and generally designated by the reference numeral 10 will be described.

The present invention, the grout injecting/structure anchoring system 10 is comprised of a plurality of components. Such components in their broadest context include a structure, a cylindrical supportive tube, a bracket, and a hollow cylindrical filling tube. Such components are individually configured and correlated with respect to each other so as to attain the desired objective.

First provided is a structure 12, such as a house 14 on a foundation 16. The structure is susceptible to instability. The instability is due to any subterranean voids 18. The structure has a foundation 16. The foundation is positionable on soil 20 over bedrock 22.

A hollow cylindrical supportive tube 24 is provided next. The supportive tube has a first inner diameter. The supportive tube is adapted to be inserted into soil adjacent to the foundation of the structure and through any subterranean void. The supportive tube has a closed bottom end 26. The closed bottom end is provided with a cap. The closed bottom end is firmly abutted to bedrock. The supportive tube has an open top end 28. The open top end is positioned adjacent to the foundation of the structure. The supportive tube further has a linear body 30 between the top end and the bottom end. A plurality of equally spaces circular apertures 32 is provided along the length of the linear body and around its circumference.

Further provided is an L-shaped support bracket 34. The support bracket is adapted to be securely placed under a foundation of a structure. The support bracket has a weight bearing horizontal portion 36. The weight bearing horizontal portion is adapted to support the foundation. The support bracket also has an aligning vertical portion 38. The aligning vertical portion has a pair of apertures 40. The apertures have horizontal bolts 42. The bolts are adapted to couple the support bracket to the foundation. The support bracket has adjusting elements. The adjusting elements include vertically oriented internally threaded sleeves 44. The adjusting elements further include a vertically oriented unthreaded sleeve 46. A cross brace 48 with laterally spaced unthreaded apertures and vertical bolts 50 are provided. Each bolt has an upper nut 52. The support bracket is adapted to hold the foundation at a level desired by a user.

Provided last is a pressurized grout dispensing unit 60. The grout dispensing unit is coupled to the upper end of the tube for dispensing grout 62 through the tube beginning adjacent to the lower end of the tube. The lower end of the tube is adjacent to the bedrock. Grout is thus allowed to pass through the apertures of the supportive tube and fill any subterranean void. This filling of the tube and subterranean void thereby function to solidify the supportive tube. This further produces a massive anchoring flange of the filled subterranean void and is coupled to the supportive tube to add further support to the building structure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A grout injecting/structure anchoring system for solidifying a structure by supporting it from bedrock and filling any subterranean voids which would otherwise cause structural instability, the system comprising, in combination:

a structure susceptible to instability due to any subterranean voids, the structure having a foundation positionable on soil over bedrock;

a hollow cylindrical supportive tube having a first inner diameter and being adapted to be inserted into soil adjacent to the foundation of the structure and through any subterranean void, the supportive tube having a closed bottom end being provided with a cap and firmly abutted to bedrock there beneath, the supportive tube having an open top end being positioned adjacent to the foundation of the structure, the supportive tube further having a linear body between the top end and the bottom end with a plurality of circular apertures equally spaced circumferentially and axially along the entire length of the linear body;

an L-shaped support bracket adapted to be securely placed under the foundation of the structure with a weight bearing horizontal portion adapted to support the foundation and an aligning vertical portion, the aligning vertical portion having a pair of apertures with horizontal bolts adapted to couple the support bracket to the foundation, the support bracket having adjusting elements including vertically oriented internally threaded sleeves and a vertically oriented unthreaded sleeve there between with a cross brace having a central section and laterally spaced on unthreaded apertures and laterally spaced vertical bolts, each bolt having an upper nut, each bolt having a lower extent secured in one of the internally threaded sleeves and an upper extent passing through one of the unthreaded aperture with an upper nut thereabove, the top of the supportive tube being in contact with the central section of the cross brace whereby the tightening of the upper nuts will lift the support bracket and loosening of the upper nuts will lower the support bracket, the support bracket thus being adapted to hold the foundation at a level desired by a user; and a pressurized grout dispensing unit coupled to the upper end of the filling tube for dispensing grout through the apertures of the supportive tube beginning adjacent to the lower end thus allowing grout to pass through the apertures of the supportive tube and fill any subterranean voids, this filling of the supportive tube and subterranean voids thereby functioning to solidify the supportive tube and produce a massive anchoring flange of the filled subterranean void which is coupled to the supportive tube to thereby add further support to the structure.

* * * * *